United States Patent [19]

Pecak

[11] Patent Number: 4,557,473

[45] Date of Patent: Dec. 10, 1985

[54] SHEET DECELERATING AND STOPPING APPARATUS

[75] Inventor: Tadeusz Pecak, Kitchener, Canada

[73] Assignee: NCR Canada Ltd. - NCR Canada LTEE, Mississauga, Canada

[21] Appl. No.: 561,488

[22] Filed: Dec. 14, 1983

[51] Int. Cl.[4] ..... B65H 9/14

[52] U.S. Cl. ..... 271/229; 271/245

[58] Field of Search ..... 271/229, 230, 231, 235, 271/245, 246, 247

[56] References Cited

U.S. PATENT DOCUMENTS

| | | | |
|---|---|---|---|
| 3,635,467 | 1/1972 | Kobayashi et al. | 271/230 |
| 3,637,203 | 1/1972 | French | 271/53 |
| 3,870,293 | 3/1975 | Simeth | 271/245 |
| 3,888,478 | 6/1975 | Alderman, Jr. et al. | 271/8 R |
| 4,185,709 | 1/1980 | Irvine | 271/229 |

OTHER PUBLICATIONS

IBM Tech. Discl. Bull., vol. 12, No. 7, Dec. 1969, "Wait Station Brake for Document Cards", L. L. Amundson et al., p. 1112.

IBM Tech. Discl. Bull., vol. 18, No. 10, Mar. 1976, "Articulated Roll and Document Gate Mechanism", J. G. Baumberger et al., p. 3199.

IBM Tech. Discl. Bull., vol. 22, No. 10, Mar. 1980, "Multifunction Gate Mechanism", J. J. Abbott et al., pp. 4387–4389.

*Primary Examiner*—Bruce H. Stoner, Jr.
*Assistant Examiner*—John A. Carroll
*Attorney, Agent, or Firm*—Albert L. Sessler, Jr.; Elmer Wargo

[57] ABSTRACT

A sheet decelerating and stopping apparatus which may be used as a staging apparatus in a sheet-feeding environment. A pivoting member having decelerating and stopping areas thereon is spring biased to an operating position in which the decelerating area on the member cooperates with a decelerating area on on wall of a sheet-feeding track in which the sheet is fed to decelerate the sheet. The stopping area on the member stops a sheet if it is not stopped by the cooperating decelerating areas. An actuator moves the member to an inoperative position to enable a sheet to be released from the apparatus.

4 Claims, 7 Drawing Figures

SHEET DECELERATING AND STOPPING APPARATUS

BACKGROUND OF THE INVENTION

This invention relates, generally, to a staging apparatus which is used in a sheet-feeding environment, and in particular, it relates to an apparatus which is capable of receiving a sheet which is travelling at a high velocity in a document track, decelerating it, and stopping it at a predetermined location without doing damage to the leading edge of the sheet.

One prior-art staging apparatus, which is used in the handling of sheets or documents, like checks being moved in a document track, utilizes a finger-type blade, for example, which is moved into the track in the path of an oncoming document to stop it by having its leading edge abut thereagainst. Suitable transport, feed rollers positioned along the track are used to feed the stopped document further downstream along the track when the finger-type blade is removed from the track.

Another prior-art, staging apparatus utilizes a pinch-gate toggle which employs a pivoting lever which pushes the document against one of the side walls of the document track to stop it instead of using a finger-type blade as mentioned in the previous paragraph.

SUMMARY OF THE INVENTION

This invention relates to a sheet decelerating and stopping apparatus which may be used in a sheet-feeding and staging apparatus, for example.

In a preferred embodiment of the invention, the apparatus comprises: means for feeding a sheet in a feeding direction, said feeding means having spaced first and second walls forming a feeding space therebetween in which said sheet is fed, said first wall having a decelerating area thereon; a member having first and second areas thereon, with said second area being located downstream from said first area with respect to said feeding direction; and means for moving said member between a first position in which said first and second areas of said member are out of said feeding space, and also for moving said member to a second position in which said first area on said member cooperates with said decelerating area on said first wall to decelerate said sheet moving towards said second area, against which said second area said sheet is stopped.

One of the features of the present invention is that it minimizes the damage to the leading edge of a document when it is stopped thereby; this is especially true when the documents are travelling at a high velocity prior to being stopped. A sample of mixed documents was passed through a document track in which the apparatus of this invention was used to check on its operation with regard to damage to the leading edges of the documents. With the present invention, after fifty such passes, there was less damage to the leading edges of the documents than there was with five such passes through one of the prior-art apparatuses mentioned.

Other features of this invention are that it is simple, rugged, inexpensive, and easy to build, install, and maintain.

These features and others will be more readily understood in connection with the following detailed description, claims and drawing.

DETAILED DESCRIPTION OF THE INVENTION

Figure 1:
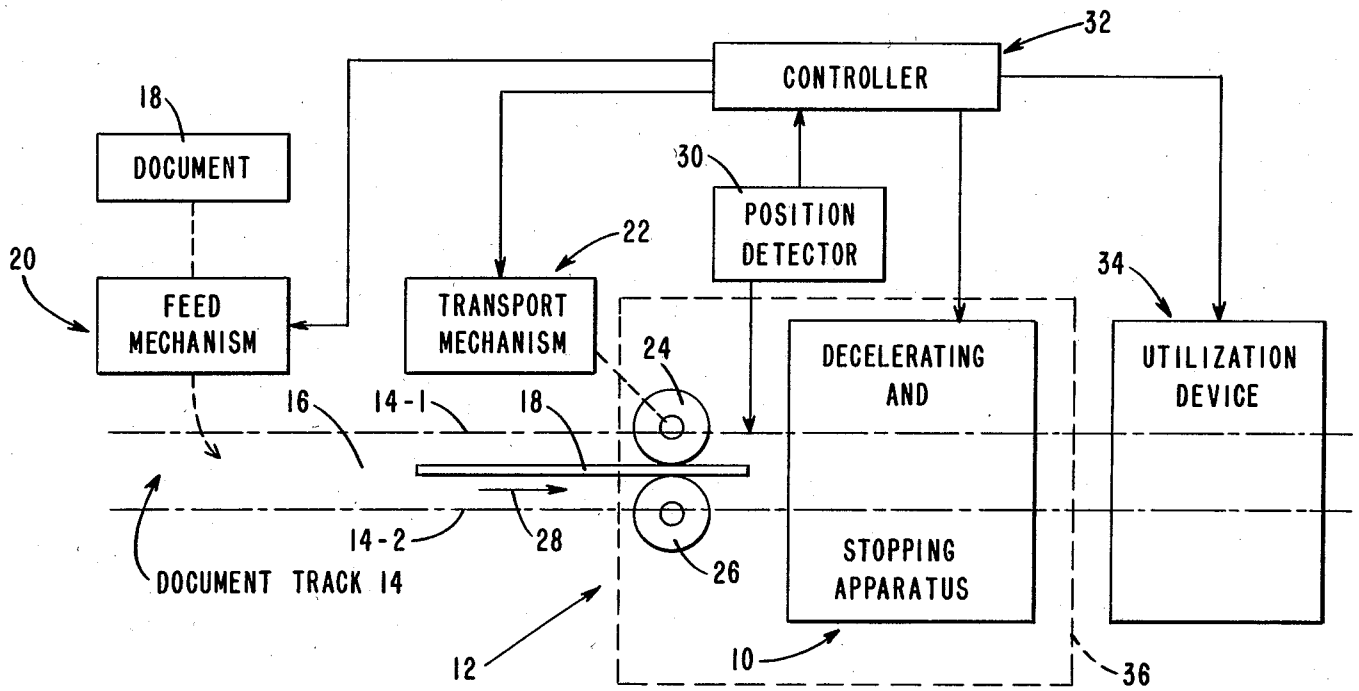
FIG. 1 is a plan view, in schematic form, showing a preferred embodiment of the decelerating and stopping apparatus of this invention in an environment in which it may be used.

FIG. 1 is a plan view, in schematic form, of a preferred embodiment of the decelerating and stopping apparatus of this invention which is designated generally as 10 and is shown in a typical, sheet-processing apparatus like an encoder 12. While the apparatus 10 is used in an encoder 12, it may be used, naturally, in other sheet-feeding environments. The apparatus 10 is especially useful in environments which require a staging area to which sheets or documents are fed and stopped momentarily and held in a "ready" position until they are needed at a utilization device located downstream from the staging area.

The encoder 12 is a conventional device which is used in the backing industry. At a certain time in the processing of documents, like checks and deposit slips, for example, it is necessary to encode or print the monetary amount of the document on the document itself; the encoder 12 provides this function among others.

The encoder 12 (FIG. 1) includes a document track 14 which has vertically-upstanding walls 14-1 and 14-2 providing a feeding space 16 therebetween in which space the documents like 18 are fed. The documents 18 are fed into the document track 14 by a feed mechanism 20 which may include mechanical pickers (not shown) or it may include a hand drop area (not shown) at which documents 18 are manually fed into the document track 14. A transport mechanism 22 is used to feed the documents 18 in a feeding direction (shown by arrow 28) along the document track 14. The transport mechanism 22 includes a plurality of drive rollers 24 and associated pinch rollers 26, for example, which are positioned along the track 14 to move the documents 18 therealong. Suitable position detectors like detector 30 are positioned along the document track 14 so as to provide position information to the controller 32 to enable it to coordinate and control the movement of documents in the encoder 12. The utilization device 34 may be an encoder or printer which prints in MICR (Magnetic Ink Character Recognition) ink, for example, on the document 18. The utilization device 34 is located downstream from the apparatus 10, and in the embodiment described, the apparatus 10 functions as a staging area (shown only as dashed outline 36) where the documents 18 are held in preparation for being moved by the transport mechanism 22 to the utilization device 34. The controller 32 controls, conventionally, the operation of the various elements shown in FIG. 1 except as will be described hereinafter.

The decelerating and stopping apparatus 10, shown only diagrammatically in FIG. 1, is shown in more detail in FIGS. 2–7. The apparatus 10 includes a base 38 (FIGS. 2 and 3) and a moveable member which is designated generally as 40, and the moveable member 40 itself is shown in detail in FIGS. 5–7. The base 38 has a vertical wall 42 upstanding therefrom, and a horizontally-positioned support 44 is detachably secured to the top end of vertical wall 42 by fasteners 46 and 48 (FIG. 4) to enable the support 44 to be mounted parallel to the base 38. A second horizontally-positioned support 45 is integrally formed with vertical wall 42 to enable the supports 44 and 45 to be positioned parallel to each other. By this construction, the moveable member 40 is pivotally mounted on a vertically-aligned pin 50, which in turn, is mounted in aligned, receiving apertures 52 and 54 (FIG. 4) which are located in support 44 and support 45, respectively. The moveable member 40 has aligned cylidrically-shaped members 55 and 57 having, respectively, aligned apertures 56 and 58 therein (FIG. 6) to receive the pin 50. The member 40 is pivoted or moved between the operative position shown in solid outline in FIG. 2 and the inoperative position shown in dashed outline 40' by moving means to be later described herein. The cylindrically-shaped members 55 and 57 are joined by a support section 59 (FIG. 6) which adds strength to the member 40.

The apparatus 10 also includes the vertical wall 60 which passes through an opening 61 in the wall 14-1 (FIG. 4) and is secured to the base 38 as shown schematically by the fastener 63. Wall 60 is aligned with wall 14-1 which is part of the document track 14, and wall portion 62 is a part of wall 14-2. The wall 60 and wall portion 62 are spaced apart to form a document receiving space 64 therebetween at the leftmost end of the wall 60 and wall portion 62, as viewed in FIG. 2, for example, in which figure, the long, top edge of the document 18 is seen. The document 18 is supported on its long, lower edge and is moved into the receiving space 64 by the transport mechanism 22 (FIG. 1).

The wall 60 (FIG. 2) has an inclined ramp 66 formed therein along the height of the wall 60 (see FIG. 4) to direct the leading edge of the document 18 towards a decelerating planar area 68 formed in the wall 60. The inclined ramp 66 on the wall 60 cooperates with corresponding inclined, aligned, upper and lower ramps 70-1 and 70-2 (FIG. 4) on the moveable member 40. These ramps 70-1 and 70-2 may be referred to collectively as ramp 70. Ramp 70 on the moveable member 40 cooperates with the inclined ramp 66 (FIG. 2) to direct the leading edge of the document 18 towards the decelerating planar area 68 on the wall 60 and corresponding decelerating planar areas 72-1 and 72-2 (FIG. 7) which will be referred to collectively as planar area 72 on the moveable member 40. The side wall portion 62 has openings 74-1 and 74-2 (FIG. 4) therein to enable the inclined ramps 70-1 and 70-2, planar areas 72-1 and 72-2, and abutment areas 76-1 and 76-2 (FIG. 6) on the moveable member 40 to be moved into the operative position shown in FIG. 2, for example.

Figure 2:
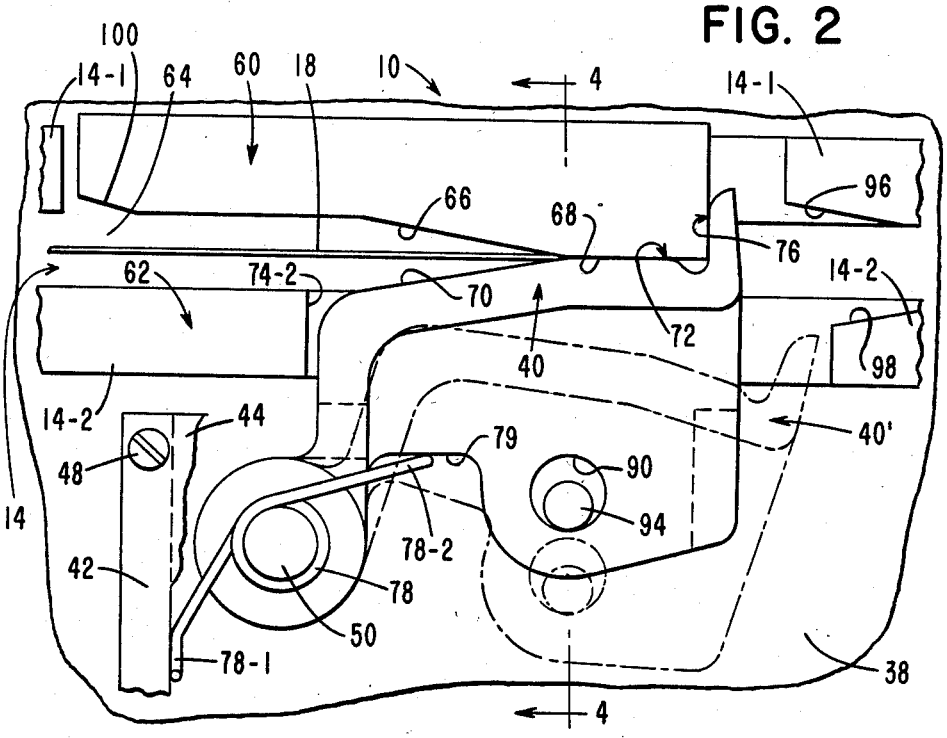
FIG. 2 is a plan view showing the decelerating and stopping apparatus in an operative position to receive a document, with its inoperative position being shown in dashed outline; in this view, certain portions of the apparatus are removed to facilitate a showing thereof.
Figure 3:
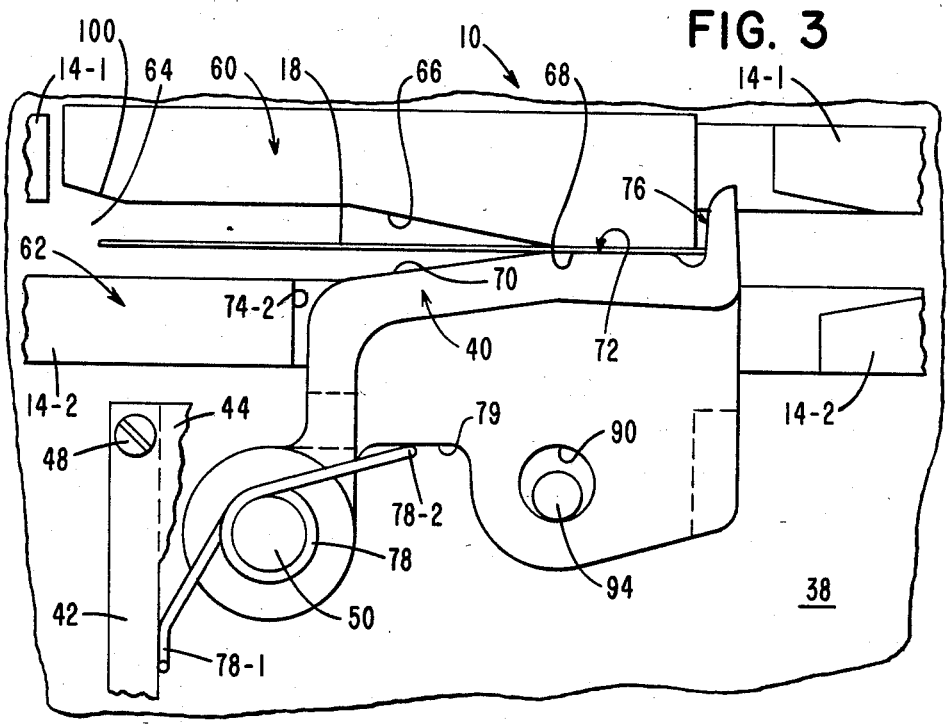
FIG. 3 is a plan view, similar to FIG. 2, showing a document stopped by the decelerating and stopping apparatus.

The moveable member 40 is moved into the operative position shown in solid outline in FIG. 2 by a torsion spring 78 (shown only in FIGS. 2 and 3). The spring 78 is mounted on the pin 50, and it has one end 78-1 which abuts against the vertical wall 42, and it has a remaining end 78-2 which abuts against a flat portion 79 (FIG. 6) of the moveable member 40 to bias the moveable member 40 to pivot in a counterclockwise direction (as viewed in FIG. 2) about pin 50. The end 78-2 of the spring 78 is also shown in FIG. 6.

The moveable member 40 is moved to the inoperative position shown in dashed outline 40' (FIG. 2) by a solenoid 82 (FIG. 4) which is under the control of the controller 32 (FIG. 1). The solenoid 82 has an operating arm 84 which is positioned or sandwiched between flanges 86 and 88 (FIGS. 4 and 6) on the operating member 40. The flanges 86 and 88 have aligned apertures 90 and 92 therein, respectively, to receive a loosely-fitted pin 94 which is secured in the operating arm 84, as shown best in FIG. 4. The pin 94 has an outside diameter which is smaller than the inside diameters of the aligned apertures 90 and 92 (FIGS. 2 and 3) so as to permit some lateral shifting of the apertures 90 and 92 of the moveable member 40 relative to the pin 94 as the operating arm 84 is withdrawn axially within the solenoid 82, and the moveable member 40 is pivoted thereby to the position shown in dashed outline 40' in FIG. 2.

Figure 4:
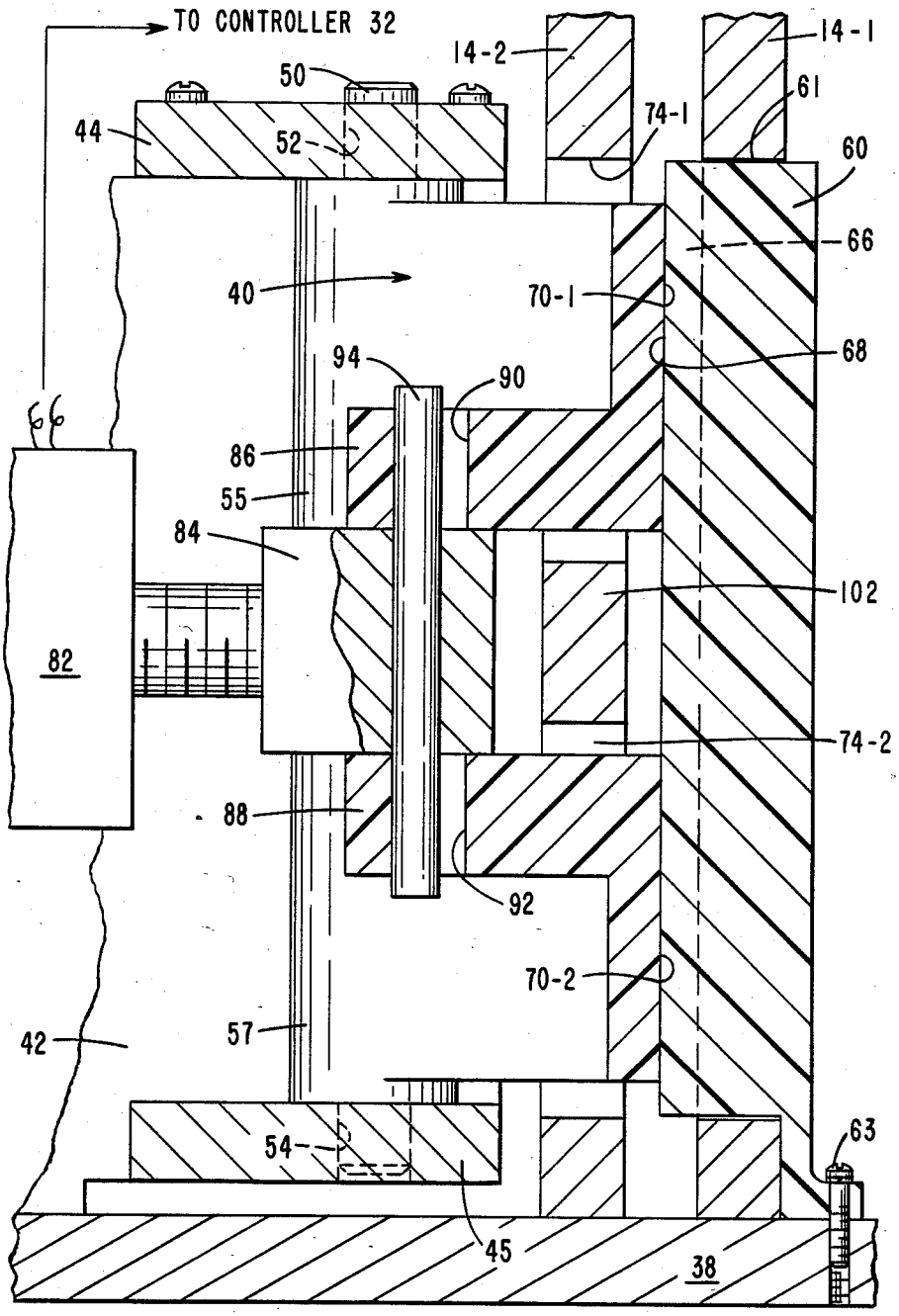
FIG. 4 is a cross-sectional view, taken along the line 4—4 of FIG. 2 to show additional details of the decelerating and stopping apparatus.
Figure 5:
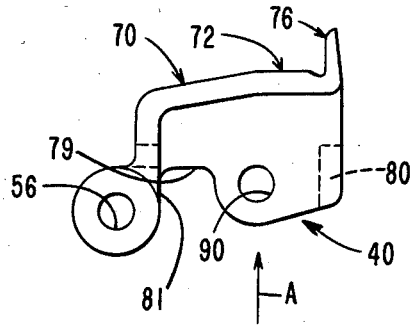
FIG. 5 is a top plan view of the moveable member of the decelerating and stopping apparatus.
Figure 7:
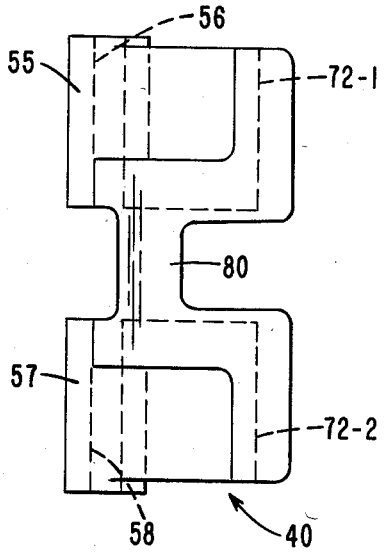
FIG. 7 is an elevational, end view of the moveable member, and the view is taken from the direction B of FIG. 6.

The operation of the decelerating and stopping apparatus 10 is as follows. Whenever the controller 32 deenergizes the solenoid 82, the spring 78 (FIG. 2) rotates or pivots the moveable member 40 in a counterclockwise direction (as viewed in FIG. 2) from the position shown in dashed outline 40' to the position shown in solid outline in FIG. 2. As a document 18 is moved into the receiving space 64 by the transport mechanism 22 (FIG. 1), the leading edge of the document 18 is deflected by the inclined ramp 66 on the wall 60 and is also deflected by the cooperating inclined ramp 70 (including individual ramp areas 70-1 and 70-2 as shown in FIG. 4) on the moveable member 40 to force the leading edge of the document 18 between the decelerating area 68 on the wall 60 and the cooperating decelerating area 72 (including individual areas 72-1 and 72-2 as shown in FIG. 7) on the moveble member 40. As the leading edge of the document 18 moves between the decelerating areas 68 and 72, the moveable member 40 is moved or pivoted slightly in a clockwise direction (as viewed in FIG. 3), against the bias of spring 78, to accommodate the thickness of the document 18. In the preferred embodiment, the wall 60 and the moveable member 40 are made of a hard, tough, synthetic plastic, polymer alloy which provides a high coefficient of friction and also provides low-wear characteristics. One such polymer alloy which is suitable for use herein is "Thordon" plastic which is a trademark of Thompson Gordon of Burlington, Canada, and which polymer alloy is currently available from Thompson Gordon. In the embodiment described, the coefficient of friction of the decelerating areas 68 and 72 is between 0.3 and 0.35 when the torsion spring 78 provides a force between the decelerating areas 68 and 72 of about 0.4 pounds. Also, the velocity of the document 18 as it travels within the document track 14 to the apparatus 10 is about 264 centimeters per second, although other parameters could be used.

Figure 6:
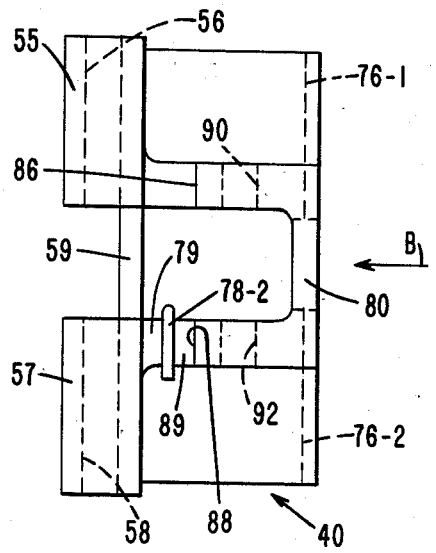
FIG. 6 is an elevational, side view of the moveable member, and the view is taken from the direction A of FIG. 5.

With the parameters described in the previous paragraph, those documents 18 which are made of paper stock being described as 16 lb. paper are decelerated by the cooperating, decelerating areas 68 and 72, before having the leading edge of the document 18 contact the abutment area 76 (including individual areas 76-1 and 76-2 as shown in FIG. 6) on the moveable member 40. Those documents 18 which are made of heavy paper stock which is described as 100 lb. paper, for example, are not decelerated to a standstill by the decelerating areas 68 and 72, and accordingly, the leading edge of the document 18 abuts against the abutment area 76.

The document 18 remains in the position shown in FIG. 3 until the controller 32 (FIG. 1) decides that the document 18, being retained by the apparatus 10 at the staging area 36, is to be released to the utilization device 34 as previously described. To release the document 18, the controller 32 energizes the solenoid 82 to move the moveable member 40 to the inoperative position shown in dashed outline 40' in FIG. 2. When released, the document 18 is moved downstream by drive roller 24 to the utilization device 34 for subsequent operations not important to an understanding of this invention.

Some additional, miscellaneous points need to be discussed. The walls 14-1 and 14-2 have "chamfered" edges as at 96 and 98, (FIG. 2), respectively, to facilitate the entry of documents 18 thereto. The upstream edge of wall 60, similarly, has a chamfer 100 to facilitate the entry of documents. When the member 40 is withdrawn to the dashed position 40' (shown in FIG. 2) by the solenoid 82, a center portion 102 (FIG. 4) of the wall 14-2 (located between the openings 70-1 and 70-2) is used to maintain the document 18 within the document track 14. While the member 40 is shown as being positioned on one side of the track 14, as seen in FIG. 2, it may be operated from the opposite side of track 14 by reversing or making a mirror image of the apparatus 10.

What is claimed is:

1. A sheet decelerating and stopping apparatus, comprising:

means for feeding a sheet in a feeding direction, said feeding means having spaced first and second walls forming a feeding space therebetween in which said feeding space said sheet is fed, said first wall having a decelerating area thereon;

a member having first and second areas thereon, with said second area being located downstream from said first area with respect to said feeding direction; and means for moving said member between a first position in which said first and second areas of said member are out of said feeding space, and also for moving said member to a second position in which said first area on said member contacts and cooperates with said decelerating area on said first wall to decelerate said sheet moving towards said second area, against which said second area said sheet is stopped;

said first and second areas of said member being substantially perpendicular to each other, with said second area being substantially perpendicular to said feeding direction when said member is moved to said second position;

said first wall having a deflecting area thereon and said member having a third area thereon which said third area cooperates with said deflecting area when said member is in said second position to direct a sheet between said decelerating area and said first area.

2. The apparatus as claimed in claim 1 in which said decelerating area of said first wall and at least said first area of said member are made of a material which provides a high coefficient of friction and low-wear characteristics;

said material being a synthetic plastic polymer alloy.

3. The apparatus as claimed in claim 1 in which said moving means comprises:

means for mounting said member for pivotal movement between said first and second positions;

means for resiliently biasing said member to said second position; and an actuator for moving said member to said first position against the bias of said biasing means.

4. A sheet decelerating and stopping apparatus, comprising:

means for feeding a sheet in a feeding direction, said feeding means having spaced first and second walls forming a feeding space therebetween in which said feeding space said sheet is fed, said first wall having a decelerating area thereon;

a member having first and second areas thereon, with said second area being located downstream from said first area with respect to said feeding direction; and means for moving said member between a first position in which said first and second areas of said member re out of said feeding space, and also for moving said member to a second position in which said first area on said member cooperates with said decelerating area on said first wall to decelerate said sheet moving towards said second area, against which said second area said sheet is stopped;

said first wall having a deflecting area thereon and said member having a third area thereon which said third area cooperates with said deflecting area when said member is in said second position to direct a sheet between said decelerating area and said first area;

said first area of said member being comprised of first and second individual areas and said second wall having first and second openings therein and also having a center portion between said first and second openings; said first and second openings being aligned with said first and second individual areas, respectively, to enable said first and second individual areas to pass through said first and second openings.

* * * * *

UNITED STATES PATENT AND TRADEMARK OFFICE

CERTIFICATE OF CORRECTION

PATENT NO. : 4,557,473

DATED : December 10, 1985

INVENTOR(S) : Tadeusz Pecak

It is certified that error appears in the above—identified patent and that said Letters Patent is hereby corrected as shown below:

Column 6, line 37 delete "re" and substitute --are--.

Signed and Sealed this

*Eighteenth* Day of *February 1986*

[SEAL]

*Attest:*

DONALD J. QUIGG

*Attesting Officer*

*Commissioner of Patents and Trademarks*